US005396720A

United States Patent [19]

Hwang et al.

[11] Patent Number: 5,396,720

[45] Date of Patent: Mar. 14, 1995

[54] FIXING STRUCTURE FOR LIGHTENING CIRCUIT OF 2-STAGE SWITCH ON LIGHTENING SHOE

[76] Inventors: Wen I. Hwang, 5F-9, No.5, Wu Chyuan 1 Rd., Hsin Chuang City; Ming C. Tsu, No.18, Sec 3, Cherng Der Rd., Taipei, both of Taiwan, Prov. of China

[21] Appl. No.: 163,230

[22] Filed: Dec. 7, 1993

[51] Int. Cl.[6] ..... A43B 23/00; F21L 15/08

[52] U.S. Cl. ..... 36/137; 36/139; 362/103; 362/276

[58] Field of Search ..... 36/137, 139; 362/103, 362/802, 276

[56] References Cited

U.S. PATENT DOCUMENTS

| | | | |
|---|---|---|---|
| 1,292,123 | 1/1919 | Steiger | 362/276 X |
| 3,059,102 | 10/1962 | Sherron | 362/276 X |
| 4,324,054 | 4/1982 | Rovinsky | 36/137 |
| 5,036,443 | 7/1991 | Humble et al. | 362/802 X |
| 5,188,447 | 2/1993 | Chiang et al. | 36/137 X |
| 5,285,586 | 2/1994 | Goldston et al. | 36/137 |
| 5,303,131 | 4/1994 | Wu | 36/137 |

FOREIGN PATENT DOCUMENTS

| | | | |
|---|---|---|---|
| 0335467 | 10/1989 | European Pat. Off. | 36/137 |
| 2556190 | 6/1985 | France | 36/137 |
| 2675025 | 10/1992 | France | 36/137 |
| 9311681 | 6/1993 | WIPO | 36/137 |

*Primary Examiner*—Paul T. Sewell
*Assistant Examiner*—Ted Kavanaugh
*Attorney, Agent, or Firm*—Pro-Techtor International

[57] ABSTRACT

A fixing structure for the light sensitive lightening circuit of 2-stage microswitch type on a lightening shoe,-wherein the shoe heel is excavated to form a receiving recess having fixing holes on the top surface and a shallow concave groove on the bottom surface thereof; a transparent fixing seat has at the top thereof lugs corresponding to the fixing holes, further at the bottom thereof a receiving groove corresponding to the shallow concave groove for receiving a lightening circuit board; the fixing seat is insertable into the receiving recess of the heel, and is formed a part of the heel by joining the lugs with the fixing holes. The circuit can be activated through the darkening of circuference, and the LEDs in the circuit can shine intermittently following another activation by the trampling action on the shoe created by walking or dancing.

1 Claim, 4 Drawing Sheets

FIXING STRUCTURE FOR LIGHTENING CIRCUIT OF 2-STAGE SWITCH ON LIGHTENING SHOE

BACKGROUND OF THE INVENTION

Lightening shoes are widely used shoes in fashion taken by stage players or young people in a dance hall or in exercise, a lightening shoe comprises in its shoe sole or its shoe heel an embeded lightening electric circuit, therefore, creates a twinkling effect by the feet motion when in dancing or exercising. This is interesting so as to be attractive and to increase amusement; while the exercise at night can have a warning effect to increase the safety of the exercise at night. Such shoes are therefore widely brought into fashion in the advanced nations of Europe and America.

The arrangement of the LEDs in the lightening shoe can have multiple types, e.g., the LEDs can be embeded in an instep, or can be embeded in a shoe sole, or in a shoe heel, the type which the present invention is related to is a structure wherein LEDs are embeded in a shoe heel. A conventional structure for a shoe heel has, as shown in FIG. 1, a groove C in the back side B of a lightening shoe A; while the circuit for lightening is received in a box D which has a size coincident with that of the groove C. The box D is wholly embeded in the groove C with glue, as shown in the drawing, the circuit for lightening within the box D is arranged to render two LEDs to extend out from the box D but withing two transparent covers E. Such a circuit for lightening is activated through a vibrating switch. Such kind of conventional lightening shoe has the following defects:

(1) The two transparent covers E on the back side B of the lightening shoe A can adversely influence the appearance of the shoe A, and also is subjected to damage as it tends to be struck by or collided with other objects.

(2) The circuit is totally sealed by hard solid glue, so that the activation of the circuit for lightening is effected only through a vibrating switch (such as a mercury switch, a magnetic reed, metallic spring or steel ball to seal the switch), so long as the circuit is moved, the vibrating switch is activated to drive an IC to render the LEDs shining and extinguishing intermittently. Such kind of lightening shoe will continuously twinkle when it is jolted in the procedure of production or in a long distance transportation or when it is worn on a foot whenever in the day time or at night. In this case, the batteries therein will be exhausted rapidly (and the user of such kind of lightening shoe A has by no means a chance for changing the batteries), and the shoe is thus out of use. Besides, it is no necessity to have a lightening shoe shining in the day time, because twinkling of LEDs is not clear then and therefore is unpractical.

SUMMARY OF THE INVENTION

In view of the above statement, and on the stand which the company owned by the inventor of the present invention has ever been having in designing, producing, and studying as well as developing products relating to the lightening shoe the inventor provides a fixed circuit structure of 2-stage switch for lightening shoe against the defects of the way of activation and the fixing structure of a conventional lightening shoe after a lot of study and amendments, tests and experiments, the production of this new structure finally succeeded with the advantages of being activatable in the night time, saving of electric power, improvement in appearance, increasing fun and amusement, The features as well as the practical functions of the present invention will be apparent from the detailed description of an embodiment thereof in reference to the accompanying drawings.

DETAILED DESCRIPTION OF THE INVENTION

Figure 1:
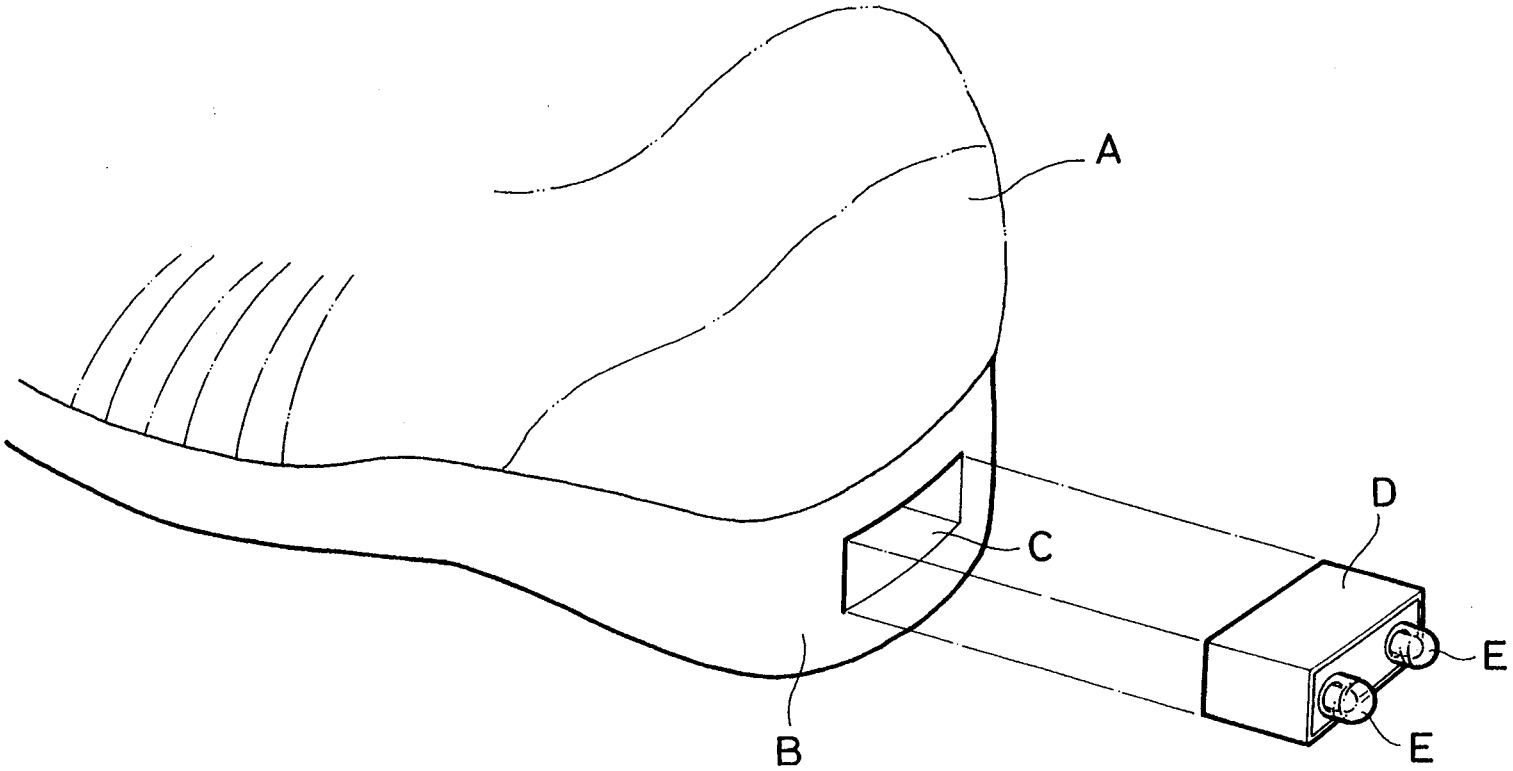
FIG. 1 (PRIOR ART)
FIG. 1 is a perspective schematic view of the lightening device in a shoe heel of a conventional lightening shoe.
Figure 2:
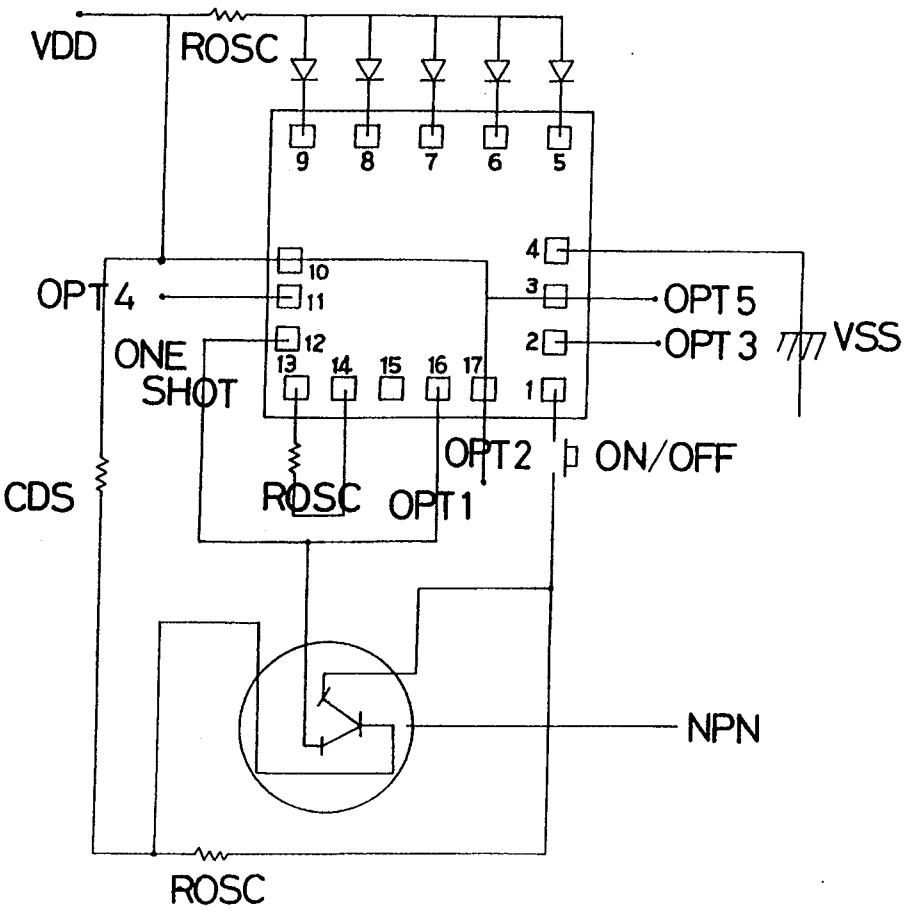
FIG. 2 is an electric circuit diagram of a light sensitive circuit for lightening of the present invention.

Referring to FIG. 2, the structure of the present invention is designed according to the "2-stage light sensitive and microswitch type circuit for lightening" as shown in this drawing,this circuit has a largest difference from a conventional lightening circuit, that is, the switch thereof gets rid of the unpractical vibration switch mode, and takes the mode of activation which is composed of a light sensitive electric resistor (CDS) and a microswitch. This light sensitive electric resistor will be in an open circuit state when the lightening circuit is put in the daylight or a place having strong light, and the light sensitive electric resistor will be responsive to present as a closed circuit state when it is in the night or in a dark place (the illumination intensity therein is less than 30 lux). While the microswitch will be in an open circuit state when it is not pressed; and it will be in a closed state when it is pressed. This electric structure will render its LEDs to lighten and twinkle (it is controlled by an IC to automatically cut the electric power within 3–8 seconds) only when it is in the night or in a dark place (the illumination intensity therein is less than 30 lux), and the microswitch is pressed to form a double closed circuit state, the LEDs will not lighten and twinkle so long as one of the light sensitive electric resistor and the microswitch is in an open state. Such design allows the shoe not to lighten or twinkle unnecessarily in the day time wherein a shoe doesn't need to be lightened, or in a still condition (in this condition, the microswitch is not pressed), and thus saves electric power.

Figure 3:
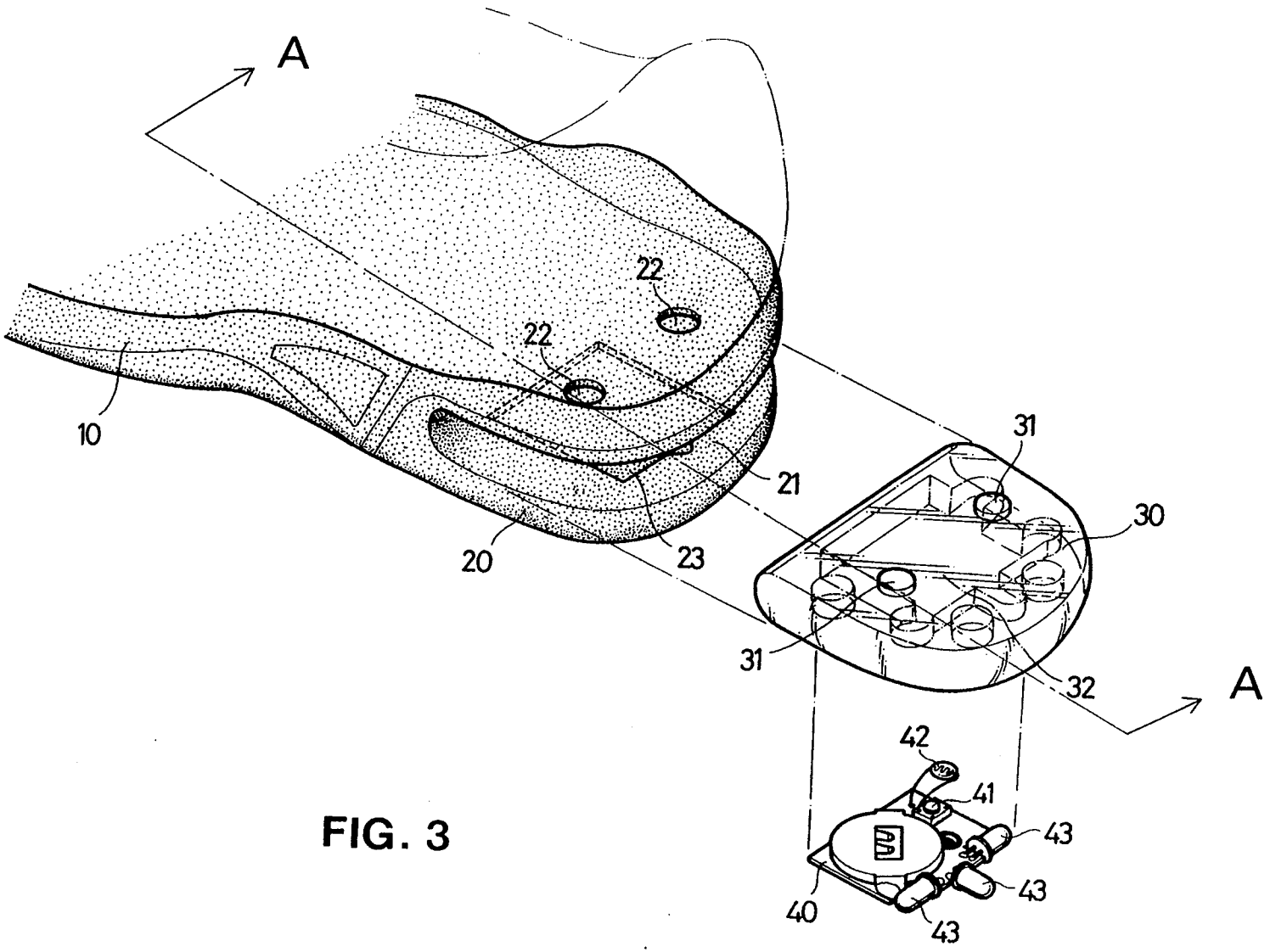
FIG. 3 is a perspective as well as anatomic schematic view of the present invention.
Figure 4:
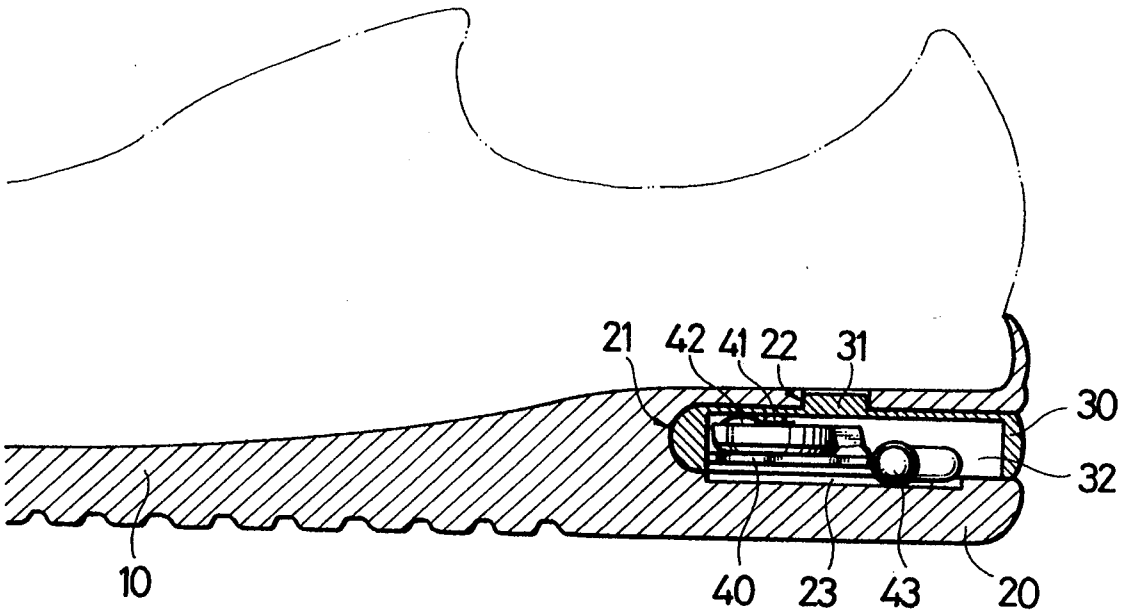
FIG. 4 is a lateral sectional view taken from a section line A—A of FIG. 3, showing the invention after assembling thereof.

Referring to FIGS. 3 and 4, the feature of the structure of the present invention is now described, the structure comprises a shoe heel 20 of a lightening shoe body 10, and a fixing seat 30 embeded into the heel 20, wherein:

the shoe heel 20: is excavated to form a receiving recess 21 which has two fixing holes 22 on the top surface thereof and a shallow concave groove 23 on the bottom surface thereof.

the fixing seat 30: is preferably made of soft and transparent material, and has a contour or size coincident with that of the receiving recess 21 of the heel 20; and at the top thereof there are two lugs 31 corresponding to the two fixing holes 22, further at the bottom thereof there is a receiving groove 32 corresponding to the shallow concave groove 23 for embedment of a lightening electric circuit board 40.

Through the above stated structure, the lightening circuit board 40 can be adhered fixedly on the receiving groove 32 of the fixing seat 30, wherein the microswitch 41 of a lightening circuit is contacted slightly with the surface of the groove 32 (but is not pressed), then the fixing seat 30 is inserted into the receiving recess 21 of the shoe heel 20 (the shoe heel 20 is made of plastic or rubber etc., it can be firstly pushed to open to have the gap therein enlarged, so as to let the fixing seat 30 insert), the fixing seat 30 is applied with glue on the top and bottom surfaces thereof, such that it can be fixedly adhered onto the receiving recess 21 to become a part of the heel 20; After insertion, the two lugs 31 on the fixing seat 30 are exactly matched with the two fixing holes 22 to further prevent the fixing seat 30 from transverse sliding movement, mean while the members of the lightening circuit board 40 can extend slightly into the shallow concave groove 23 to enhance the strength of the structure.

When a user wears such kind of lightening shoe body 10 on his/her foot, and when it is in the day time or in a place having strong light, a light sensitive electric resistor 42 as stated above in reference to FIG. 2 will sense the light source through the fixing seat 30 of the nature of transparency to become an open circuit state, in this case, the LEDs 43 on the lightening circuit board 40 will not lighten; while when it is in the night or in a place such as a dark dance hall, the light sensitive electric resistor 42 will sense the light change to activate the circuit, and when the lightening shoe body 10 is trampled by the user (such as being standing up, walking or dancing to contact the floor), the microswitch 41 will be pressed as the body weight of the user presses the shoe heel 20 to form a closed circuit state, so that the LEDs 43 will twinkle (for about 3–8 seconds according to the set time of an IC); when the lightening shoe body 10 is lifted off the floor, the microswitch 41 will be released from the weight of the body to present an open circuit state, in this case, the LEDs 43 will not lightening again. Thus the lightening shoe body 10 having the present invention will intermittently shine following the actions of walking, dancing etc., to achieve the effect of increasing fun, amusement, and twinkling in due time and due place, and thus saving electric power. Further, the structure has a totally smooth and integrate appearance of the rear side of the shoe heel 20, no more protuberance, yet the electronic members are protected in the fixing seat 30 from collision or damage, so as to increase the life of use thereof.

Accordingly, the novel structure design of the present invention delicately utilizes the lightening circuit with a light sensitive electric resistor to not only get rid of the defects resided in the mode of activation and structural design of a conventional lightening shoe, but also provide the effects of shining in due time and due place, saving electric power, protecting electronic members, increasing the life of use, and increasing beauty of the whole shoe as well as increasing fun, amusement. Such a structure has never been in the similar products. It is therefore novel and practical and is submitted for application of a patent.

Obviously, many modifications and variations of the present invention are possible in the light of the above teachings. It is therefore to be understood that within the scope of the appended claims, the invention may be practised otherwise than as specifically described.

It is claimed:

1. A fixing structure for the lightening circuit of 2-stage switch type on a lightening shoe, comprising:

a shoe heel of a lightening shoe body, a light sensitive 2-stage lightening circuit having a microswitch embedded in a fixing seat, wherein said structure being characterized in that said shoe heel includes a receiving recess which has two fixing holes on a top surface thereof and a shallow concave groove on a bottom surface thereof, said fixing seat being preferably made of soft and transparent material, and having a contour and size coincident with that of said receiving recess of said heel; and at a top thereof there being two lugs corresponding to said two fixing holes, further at a bottom thereof there being a receiving groove corresponding to said shallow concave groove to receive a lightening electric circuit board; said fixing seat being connected in said receiving recess of said heel by glue and the joining of said lugs with said fixing holes to form a part of said heel.

* * * * *